US008944719B2

(12) United States Patent
Frelich et al.

(10) Patent No.: US 8,944,719 B2
(45) Date of Patent: Feb. 3, 2015

(54) TRACKING OF MACHINE SYSTEM MOVEMENTS IN PAVING MACHINE

(71) Applicant: Caterpillar Paving Products Inc., Brooklyn Park, MN (US)

(72) Inventors: Toby A. Frelich, Saint Michael, MN (US); Steven E. Hourscht, Big Lake, MN (US); Rick L. Mings, Andover, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 71 days.

(21) Appl. No.: 13/673,367

(22) Filed: Nov. 9, 2012

(65) Prior Publication Data

US 2014/0133906 A1 May 15, 2014

(51) Int. Cl.

| | |
|---|---|
| ***E01C 23/07*** | (2006.01) |
| ***E01C 19/18*** | (2006.01) |
| ***E01C 7/06*** | (2006.01) |
| ***G06F 7/70*** | (2006.01) |
| ***E01C 19/00*** | (2006.01) |

(52) U.S. Cl.
CPC ..... *E01C 19/00* (2013.01)
USPC ..... 404/84.1; 404/75; 404/108; 701/50

(58) Field of Classification Search
CPC ..... E01C 19/48; E01C 19/185; E01C 19/006; E01C 19/004; E01C 19/288; E01C 23/088; E01C 23/06; E01C 2301/04; E01C 2301/02
USPC ..... 404/84.05, 84.1, 101, 108; 701/50
See application file for complete search history.

(56) References Cited

U.S. PATENT DOCUMENTS

| | | | | |
|---|---|---|---|---|
| 4,853,856 | A | 8/1989 | Hanway | |
| 5,356,238 | A * | 10/1994 | Musil et al. | 404/84.1 |
| 5,484,227 | A * | 1/1996 | Ikeda et al. | 404/84.1 |
| 5,540,518 | A * | 7/1996 | Wambold | 404/84.05 |
| 5,727,900 | A * | 3/1998 | Sandstrom | 404/84.1 |
| 5,908,459 | A * | 6/1999 | Rower et al. | 701/50 |
| 6,109,825 | A * | 8/2000 | Yon | 404/84.05 |
| 6,609,064 | B1 | 8/2003 | Dean | |
| RE38,632 | E | 10/2004 | Schmidt et al. | |
| 7,172,363 | B2 | 2/2007 | Olson et al. | |
| 7,694,805 | B2 | 4/2010 | Schneider et al. | |
| 7,856,302 | B2 | 12/2010 | Rasmussen | |
| D632,308 | S | 2/2011 | Kopacz et al. | |
| 7,898,403 | B2 | 3/2011 | Ritter et al. | |
| 7,946,787 | B2 * | 5/2011 | Glee et al. | 404/84.8 |
| 8,079,776 | B2 * | 12/2011 | Lossow | 404/84.5 |
| 2002/0168226 | A1 * | 11/2002 | Feucht et al. | 404/84.1 |
| 2004/0039504 | A1 | 2/2004 | Coffee et al. | |
| 2008/0038059 | A1 * | 2/2008 | Frelich | 404/75 |
| 2009/0324331 | A1 * | 12/2009 | Glee et al. | 404/75 |

(Continued)

*Primary Examiner* — Abigail A Risic
(74) *Attorney, Agent, or Firm* — Miller, Matthias & Hull

(57) ABSTRACT

Methods and apparatus for tracking manual operations during automatic control of a surface-engaging operation, such as laying a mat on a paving surface, include automatically operating a plurality of components to perform the surface-engaging operation without the actuation of corresponding operator controls. Actuation of the operator controls and actuation of the corresponding components to perform a manual operation can occur during the automatic operation. Information corresponding to the manual operation is recorded in response to detecting actuation of the operator controls and determining that the automatic operation of the machine is occurring.

20 Claims, 6 Drawing Sheets

(56) References Cited

U.S. PATENT DOCUMENTS

2010/0014916 A1* 1/2010 Green ..... 404/84.1
2010/0324955 A1 12/2010 Rinehart et al.
2012/0288328 A1* 11/2012 Minich ..... 404/72
2013/0195550 A1* 8/2013 Bertz et al. ..... 404/72

* cited by examiner

TRACKING OF MACHINE SYSTEM MOVEMENTS IN PAVING MACHINE

TECHNICAL FIELD

The present invention is generally directed to paving machines and other types of surface-acting machines operating on a surface and, more particularly, to tracking and recording information relating to manual actions taken by operators of the machines that can compromise the integrity of the surface.

BACKGROUND

When building roadways, parking lots and the like, for example, paving machines may be used to deposit paving material, such as asphalt, on a paving surface to create a flat, consistent surface over which vehicles will travel. A paving machine at the construction site, such as an asphalt paver, is generally a state-of-the art self-propelled construction machine designed to receive, convey, distribute, profile and partially compact the asphalt material. The paving machine accepts asphalt material that is heated to an appropriate temperature for flow and even spreading into a receiving hopper at the front of the machine. The asphalt material in the hopper is conveyed to the rear of the machine with parallel slat conveyors or other types of conveyors positioned at the bottom of the hopper. The asphalt material conveyed from the hopper is distributed along the width of an intended ribbon or mat by means of two opposing screws or spreading conveyors or augers, and a free-floating screed profiles and compacts the asphalt material into a mat on the paving surface.

The operation of the paving machine and its components may be manually controlled by the operator(s) to dispense the asphalt material and create the mat on the paving surface. In many paving machines, systems are provided to automate and control the paving process for consistent operation of the paving machine for laying a uniform mat on the paving surface without defects compromising the integrity and longevity of the mat. The automation systems may include control over the speed of the paving machine, operation of the conveyors and augers to distribute the asphalt material, and vertical positioning and temperature control of the screed. The control settings may be established during an initial setup process for a paving job, such as the paving of a stretch of a highway or the paving of a parking lot.

When operating the paving machine in the automated mode under the guidance of the control system, it may become necessary at times during the paving job for an operator to manually intervene in the automated operation of the paving machine to address conditions arising as the asphalt mat is being laid. Such manual interventions may or may not affect the quality of the asphalt mat. For example, when the hopper is nearly emptied of a load of asphalt material, the paving machine may need to be stopped to wait for a truck to arrive with a fresh load of asphalt material to refill the hopper. During the time that the paving machine is stopped, asphalt material in a pile behind the machine and in front of the screed, or in the newly-formed mat positioned under the screed, may settle or cool so that a lump where the pile sits or depression in the mat under the screed may be left when the paving machine begins moving after the hopper is refilled.

Before refilling the hopper, material collecting at the sides of the hopper may be fed to the conveyors by manually activating actuators for raising the right and/or left side of the hopper. A temperature gradient may exist so that the asphalt material at the sides of the hopper is cooler than the asphalt material at the middle of the hopper. The cooling may cause a loss of moisture and compaction of the asphalt material that can affect the quality of the mat formed from the cooled material. In other situations, control of the conveyors may cause too little asphalt material to flow from an otherwise full hopper and create a risk of starving the screed by providing too little material to fully form the mat. When this occurs, the operator may manually override the conveyor speed to increase the flow of asphalt material from the hopper. The conveyor speed increase may cause a sudden surge of asphalt material that can cause a bump, cold spot or material segregation in the mat.

Systems exist for detecting construction equipment process failures. One such system is disclosed in U.S. Pat. No. 7,898,403, entitled "Detecting Construction Equipment Process Failure" and issued to Ritter et al. on Mar. 1, 2011. According to one embodiment of the reference, information about a construction equipment asset from a reporting source is received. A database is the populated with the information. A process failure report is provided if the construction equipment asset is operated in a manner which violates a process norm assigned to the construction equipment asset. This reporting applies to failures of the construction equipment, but not to manual interventions by operators that are not equipment process failures as discussed herein and that do not necessarily relate to equipment failures.

In currently known paving machines, these types of manual interventions occur and may or may not be noted by the operators in a job log or other formal or informal reporting format. Where they are not logged by the operators, repetitive, systematic errors in laying the asphalt mat may be occurring without knowledge of the paving contractor and customer. Problems may be occurring that are not immediately apparent, but may lead to premature degradation and replacement of the current and other surface that may be preventable if the issues were timely diagnosed. In view of this, a need exists for improved identification and evaluation of manual actions taken by paving machine operators that indicate conditions or situations that compromise the integrity of the asphalt mat.

SUMMARY OF THE DISCLOSURE

In one aspect of the present disclosure, a surface work machine for performing a surface-engaging operation on a work surface traversed by the surface work machine is disclosed. The surface work machine includes a traction device for propelling the surface work machine over the work surface, a plurality of components each having an effect on the surface-engaging operation performed by the surface work machine, a plurality of operator controls, each of the plurality of operator controls corresponding to one of the plurality of components, and a controller operatively coupled to the plurality of components and the plurality of operator controls. The controller is configured to detect actuation of each of the plurality of operator controls, to cause a corresponding at least one of the plurality of components to actuate in response to detecting the actuation of one of the plurality of operator controls, to automatically operate the plurality of components to perform the surface-engaging operation without the actuation of corresponding operator controls in response to engagement of an auto mode, and to record information corresponding to a manual operation of at least one of the plurality of components in response to detecting actuation of the corresponding one of the plurality of operator controls by an operator of the surface work machine and determining that the auto mode is engaged.

In another aspect of the present disclosure, a method for tracking manual operations of a surface work machine when the surface work machine is under automatic control of a controller to perform a surface-engaging operation on a work surface traversed by the surface work machine is disclosed. The surface work machine includes a traction device for propelling the surface work machine over the work surface, a plurality of components each having an effect on the surface-engaging operation performed by the surface work machine, and a plurality of operator controls, each of the plurality of operator controls corresponding to one of the plurality of components. The method includes automatically operating the plurality of components to perform the surface-engaging operation without actuation of corresponding operator controls in response to engagement of an auto mode, detecting actuation of one of the plurality of operator controls by an operator of the surface work machine, causing a corresponding at least one of the plurality of components of the surface work machine to actuate to execute a manual operation in response to detecting actuation of the one of the plurality of operator controls, and recording information corresponding to the manual operation of the at least one of the plurality of components in response to detecting actuation of the one of the plurality of operator controls and determining that the auto mode is engaged.

Additional aspects are defined by the claims of this patent.

DETAILED DESCRIPTION

Although the following text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

It should also be understood that, unless a term is expressly defined herein, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to herein in a manner consistent with a single meaning, that is done for sake of clarity only so as to not confuse the reader, and it is not intended that such claim term be limited, by implication or otherwise, to that single meaning.

Figure 1:
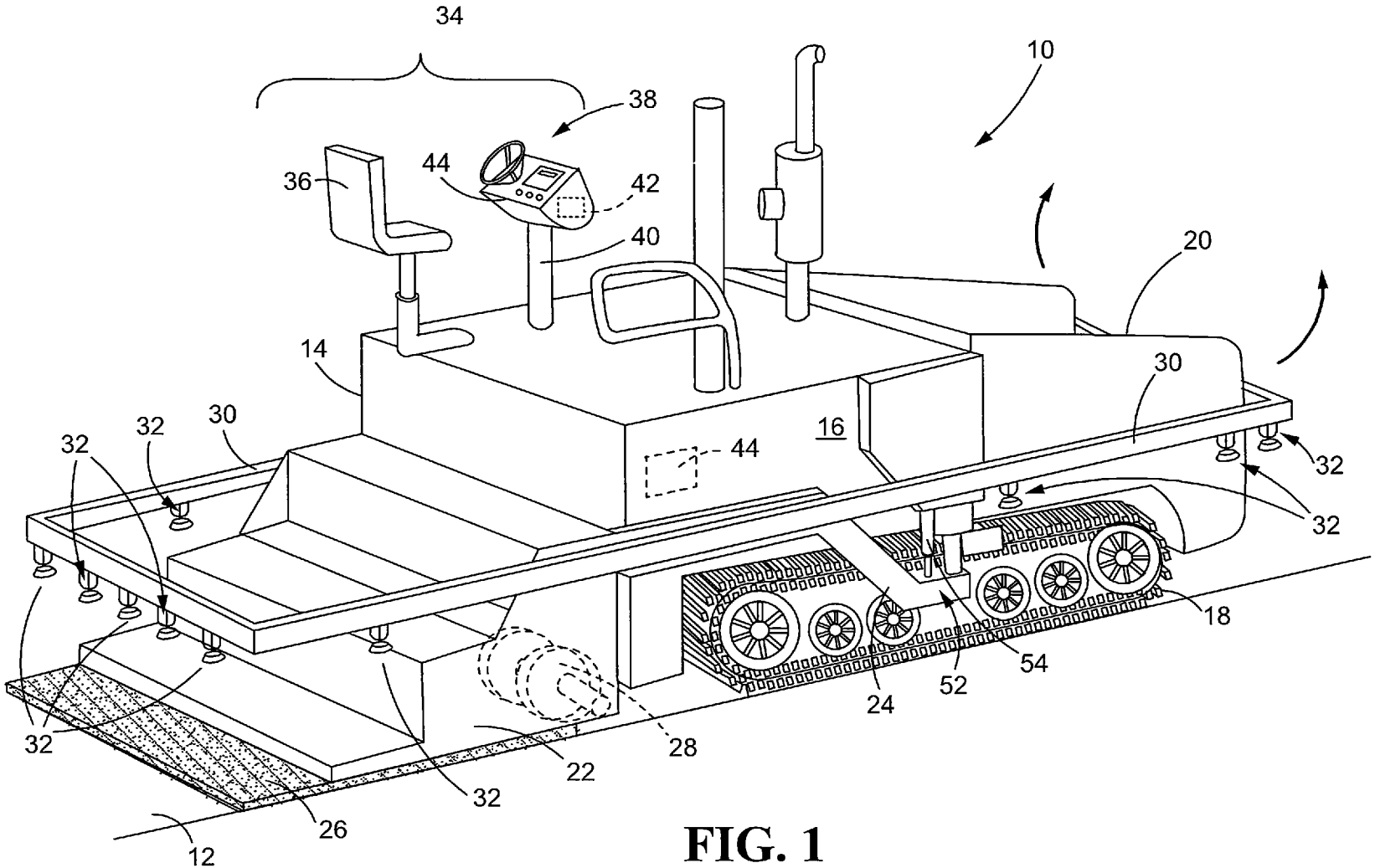
FIG. 1 is a perspective view of a paving machine.

FIG. 1 is an illustration of a paving machine 10. Although the paving machine 10 is depicted in the figures as an asphalt paver, the presently disclosed control system may be used on any kind of paving machine for any kind of paving material that may form a layer of material on a paving surface 12 and where the quality of the formed layer may vary based on variations in the operation of the paving machine 10. Exemplary paving materials for which the disclosed control system may be used include asphalt, concrete, and loose aggregate materials such as crushed gravel. The paving machine 10 includes a tractor 14 having a power source 16, such as an engine or motor, one or more traction devices 18, and a hopper 20 for containing paving material. The traction devices 18 may be operatively coupled to the power source 16 by a transmission mechanism (not shown) to drive the traction devices 18 and propel the paving machine 10. Although the traction devices 18 are shown in the figures as tracks, the traction devices 18 could alternatively be wheels or any other type of traction devices. The traction devices 18 could also be combinations of different types of traction devices. For example, paving machine 10 could include both tracks and wheels.

The paving machine 10 also includes a screed 22 attached to tractor 14 by tow arms 24 and towed behind tractor 14 to spread and compact the paving material into a mat 26 on the paving surface 12. The screed 22 may include one or more augers 28 for spreading the paving material to the lateral extents of the screed 22. In addition, the paving machine 10 includes a sensor frame 30 attached to the screed 22 and/or to the tow arms 24. The sensor frame 30 may include one or more sensors 32 that may sense values of various parameters relating to the operation of the paving machine 10, such as the height of the paving machine 10 at various locations, and temperatures of the paving material, the screed 22 and the mat 26.

The paving machine 10 also includes an operator station 34 for one or more operators. The operator station 34 includes a seat 36 and an operation console 38 that may be mounted on a pedestal 40. The operator station 34 includes a controller 42 as well as a user interface 44 for accepting user input and displaying information to the operator. The user interface 44 may have a combination of buttons, switches, dials, levers, touch screens and other control devices that may allow the operator to input commands to the controller 42 for controlling the operation of the various components of the paving machine 10.

Figure 2:
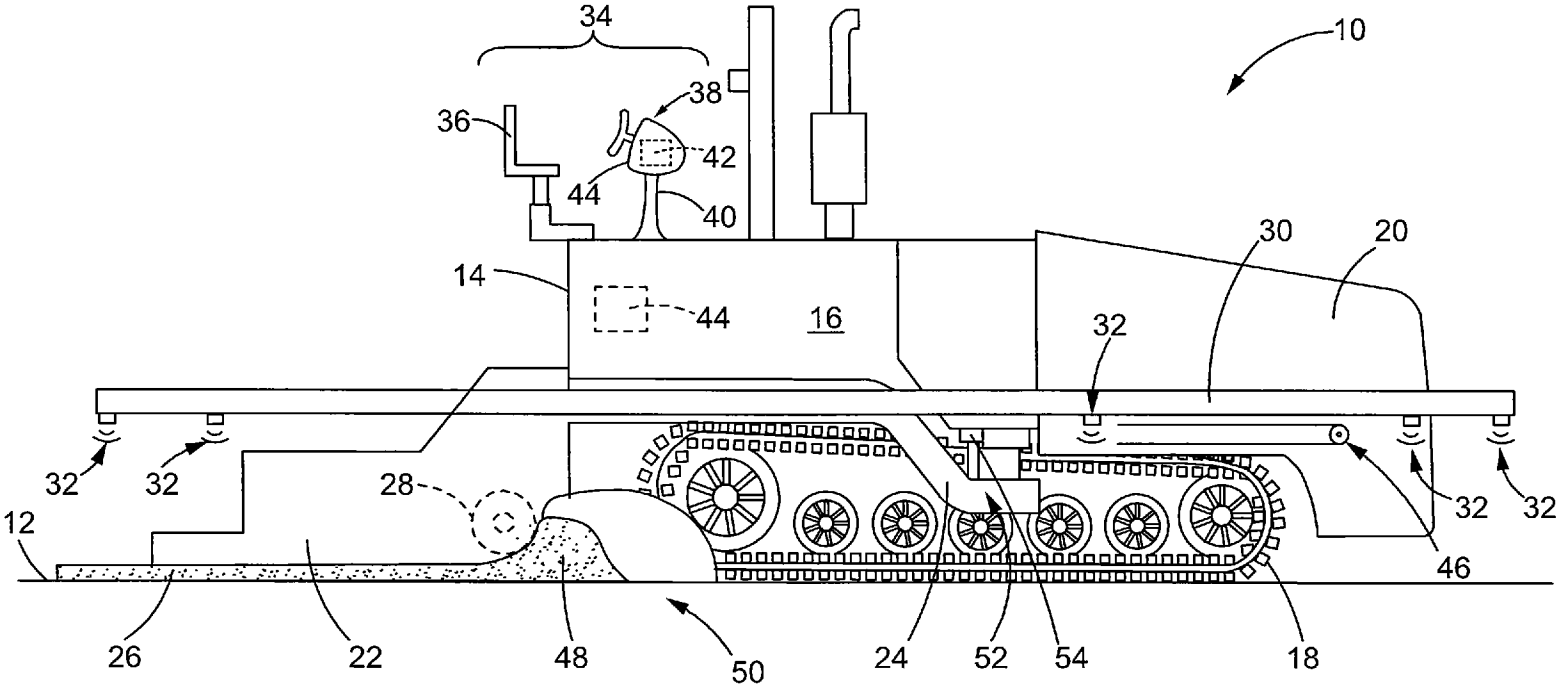
FIG. 2 is a side view of the paving machine of FIG. 1.

The hopper 20 of the paving machine 10 contains the paving material that is to be formed into the mat 26 on the paving surface 12. The paving material may be dumped into the hopper 20 at the front of the paving machine 10 from trucks that deliver the paving material to a work site. Referring to FIG. 2, the paving machine 10 may include one or more conveyors 46 at the bottom of the hopper 20. The conveyors 46 may be positioned side-by-side and run parallel to one another proximate the center of the hopper 20 along a midline of the paving machine 10. The hopper 20 is generally configured to feed the paving material from the sides of the hopper 20 toward the center and the conveyors 46 may transport paving material from the hopper 20 to the rear of the tractor 14 where it may be dropped behind the tractor 14 in front of the screed 22 and onto the paving surface 12 in a pile 48 (shown in a cut away portion 50 of FIG. 2). As the paving machine 10 travels forward, the pile 48 may be evenly spread and compacted by the screed 22. Some of the material at the outward sides of the hopper 20 may not feed down to the conveyors 46 and instead accumulates at the sides of the hopper 20. Funneling of the accumulated material to the conveyors 46 may be promoted by having the left and right sides of the hopper 20 articulate so that the sides may be raised by actuators (not shown) together or independently to cause the material to flow down to the conveyors 46 (motion indicated by arrows in FIG. 1).

The speeds of the conveyors 46 may be variable to make the pile 48 higher or lower. The height of the pile 48 may be increased or decreased by varying the speed of the conveyors 46 relative to the speed at which paving machine 10 is traveling. For example, if the speed of the conveyors 46 is high relative to the speed of the paving machine 10, then the paving material may accumulate behind the tractor 14 in front of the screed 22, thus resulting in a relatively taller pile 48. If the speed of the conveyors 46 is low relative to the speed of the paving machine 10, then the paving material may be spread over a longer stretch of the paving surface 12 resulting in a relatively shorter pile 48. The speed of each conveyor 46 may be independently variable. Independently varying the speeds of conveyors 46 may enable an increase or decrease in the height of the pile 48 toward one side of paving machine 10 or the other. This feature may be used to even out an inadvertently lopsided pile 48 or to purposely create a lopsided pile 48.

The screed 22 spreads the pile 48 evenly and compacts the paving material into the mat 26 on the paving surface 12. The screed 22 is shown in the figures as a floating-type screed. However, the screed 22 may be any type of screed for any type of paving material. The screed 22 is attached to the tractor 14 at tow points 52 by the tow arms 24. The height of the screed 22 is adjusted by raising and/or lowering the tow arms 24 at the tow points 52 with screed height actuators 54. The screed height actuators 54 may be any suitable actuators, such as, for example, hydraulic cylinders. When the paving machine 10 is in motion, the screed 22 floats on a layer of paving material at a substantially consistent height relative to the height of the tow arms 24 at tow points 52. The operator is able to adjust the height of the screed 22 during the paving job via appropriate controls at the operation console 38 as discussed further below.

The augers 28 of the screed 22 are engaged to spread the paving material in the pile 48 evenly beneath the screed 22. Although the figures show only one auger 28, the paving machine 10 may have a single auger 28 or any number of augers 28 that may be necessary to distribute the paving material across the width of the screed 22. In an exemplary embodiment, the paving machine 10 may include two augers 28 that may be aligned end-to-end and situated crossways within the screed 22. Each auger 28 may be independently controlled in order to control the distribution of paving material behind the paving machine 10. Differing auger settings may be used to compensate for imbalances in the delivery of the paving material to the screed 22 or to create desired imbalances in the mat 26 formed by the paving machine 10. The speed of each auger 28 may be independently variable. For example, if more paving material is being transported by one conveyor 46 than another, the pile 48 will be higher toward one side of the paving machine 10. Increasing the speed of the auger 28 on the side of paving machine 10 with the higher portion of the pile 48 may correct for the lopsided pile height by spreading the paving material evenly.

The height of the augers 28 may also be adjusted. Auger height may be adjusted in order to position the augers 28 at the proper height so as to sufficiently spread the pile 48. After spreading the paving material, the screed 22 smoothes and compacts the paving material into the mat 26. If the augers 28 are too high, the pile 48 may not be sufficiently spread and the screed 22 may not be able to smooth it out completely and form the mat 26 with the appropriate thickness. If the augers 28 are too low, the augers 28 may disrupt the paving material such that insufficient material is in the pile 48 for the screed 22 to smooth and compact for the height at which the screed 22 is set. After the screed 22 has laid the mat 26, a roller machine (not shown), separate from paving machine 10, may be used to provide additional compaction of the mat 26.

Figure 3:
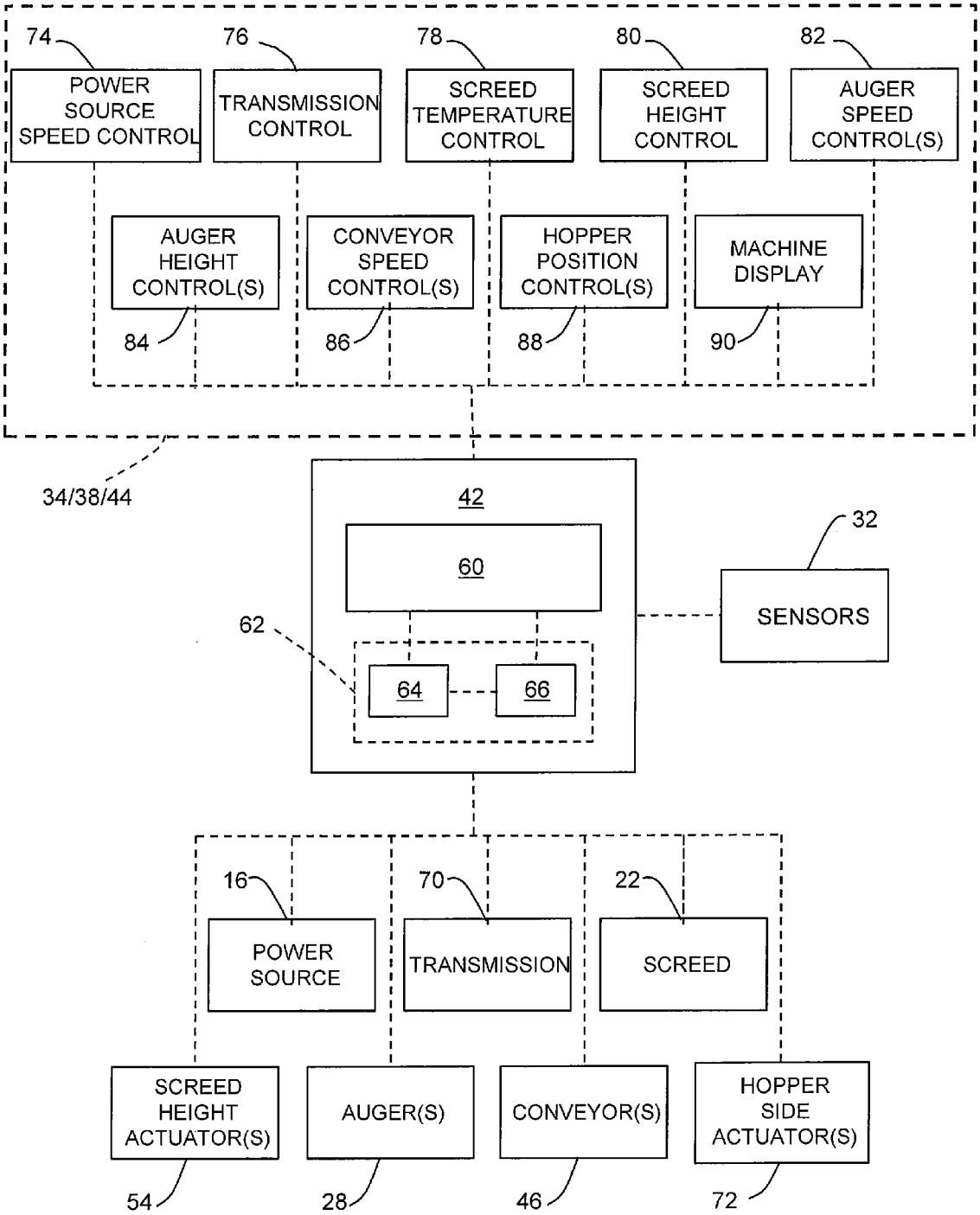
FIG. 3 is a schematic view of the operational components and the control system components of the paving machine of FIG. 1.

Referring now to FIG. 3, the controller 42 includes a microprocessor 60 for executing a specified program, which controls and monitors various functions associated with the paving machine 10. The microprocessor 60 includes a memory 62, such as ROM (read only memory) 64, for storing a program or programs, and a RAM (random access memory) 66 which serves as a working memory area for use in executing the program(s) stored in the memory 62. Although the microprocessor 60 is shown, it is also possible and contemplated to use other electronic components such as a microcontroller, an ASIC (application specific integrated circuit) chip, or any other integrated circuit device. The controller 42 electrically connects to the power source 16, a transmission 70 connecting the power source 16 to the traction device 18, the screed 22 and screed height actuator(s) 54, the auger(s) 28, the conveyor(s) 46 and one or more hopper side actuator 72. The controller 42 also electrically connects to the one or more sensors 32 mounted to the sensor frame 30 or at other locations on the tractor 14 and the screed 22 to provide the controller 42 with data related to various parameters indicative of the operation of the paving machine 10.

Controls for the various operational components of the paving machine 10 are located in the operator station 34 at the user interface 44 on the operation console 38 or at other locations that are accessible to the operator positioned in the seat 36. Some or all of the control functions of the paving machine 10 may also be performed by an operator at the ground level via a second user interface 44 positioned on a side of the tractor 14. The controls may include a speed control 74 for the power source 16 such as a throttle pedal, a transmission control 76 for controlling the transmission 70 to propel the tractor 14 that may be in the form of a gear shift lever or other similar mechanism, a screed temperature control 78 for setting the temperature produced by heating elements in the screed 22, and a screed height control 80 providing signals to cause the screed height actuator(s) 54 to vary the height of the screed 22. The controls may further include an auger speed control(s) 82 and an auger height control(s) 84 for controlling the distribution of the asphalt material from the pile 48 across the screed 22, a conveyor speed control(s) 86 for the hopper conveyor(s) 46, and a hopper position control(s) 88 for controlling the hopper actuator(s) 72 to raise and lower the sides of the hopper 20.

In addition to the individual operator controls 74-88, the user interfaces 44 may include a machine display 90 for displaying information related to the operation of the paving machine 10. In a basic implementation, the machine display 90 may be a video display device providing information to the operator as the paving machine 10 is operated. In more sophisticated implementations, the machine display 90 may include input devices and/or be a touch screen device allowing the operator to navigate through information that may be available to be displayed. This type of machine display 90 may also allow for some or all of the individual operator controls 74-88 to be performed via functionality provided on the machine display 90. For example, graphical controls for parameters such as screed temperature, auger and conveyor speeds, screed, auger and hopper side heights and the like may be displayed on the machine display 90 and varied via the input devices of the machine display 90 to achieve the desired performance of the paving machine 10 in forming the mat 26 on the paving surface 12. For the controls provided at the machine display 90, it may be possible to eliminate corresponding mechanical or electro-mechanical controls from the operation console 38 if desired.

In the more advanced implementations of the machine display 90, the controller 42 may be programmed with software to automate the operation of the paving machine 10 so that requirements for a paving job may be defined and operation of the paving machine 10 and its components may be performed by the controller 42 to form the mat 26 with desired characteristics. Such software may allow an operator or supervisor to specify the operating parameters of components such as the screed 22, augers 28, and conveyors 46, as well as the speed of the paving machine 10, so that the paving machine 10 lays the desired mat 26. Alternatively, the controller 42 may be pre-programmed so that the machine display 90 may allow the operator or supervisor to specify the characteristics of the mat 26 to be laid. Once the characteristics of the mat 26 are specified, the controller 42 may determine the operation parameters for the paving machine 10 that are necessary to form the specified mat 26, and then control the paving machine 10 and its components to operate accordingly when laying the mat 26. Those skilled in the art will understand that the controller 42 may be programmed through other means with the information necessary for a particular paving job. For example, the parameters for the paving job may be programmed at a remote computing device and downloaded to the controller 42 via wireless transmission, direct connection to the computing device or other peripheral device such as a flash drive or other external memory device. These and other mechanisms for inputting requirements for the automated operation of the paving machine 10 to form a mat 26 on the paving surface 12 are contemplated by the inventors as having use in paving machines 10 and methods in accordance with the present disclosure.

With the paving requirements programmed or otherwise loaded into the controller 42, the paving machine 10 may be operated either manually under the control of the operator(s) or automatically under the control of the controller 42 to lay the mat 26 on the paving surface 12. The asphalt mat quality is extremely important to the paving process, and the automated control of the paving machine 10 by the controller 42 improves the quality and consistency of the mat 26 produced by the paving machine 10. At times such as those described above, however, the operator must intervene with manual overrides to the automated paving process that can introduce mat defects. Paving machines 10 in accordance with the present disclosure may be configured with manual operation tracking functionality allowing the paving contractor and customer to identify the occurrences of the manual operations, to identify the locations of the mat 26 where the manual operations, and corresponding mat defects if any, may have occurred, and to diagnose causes for the manual interventions by the operator.

Figure 4:
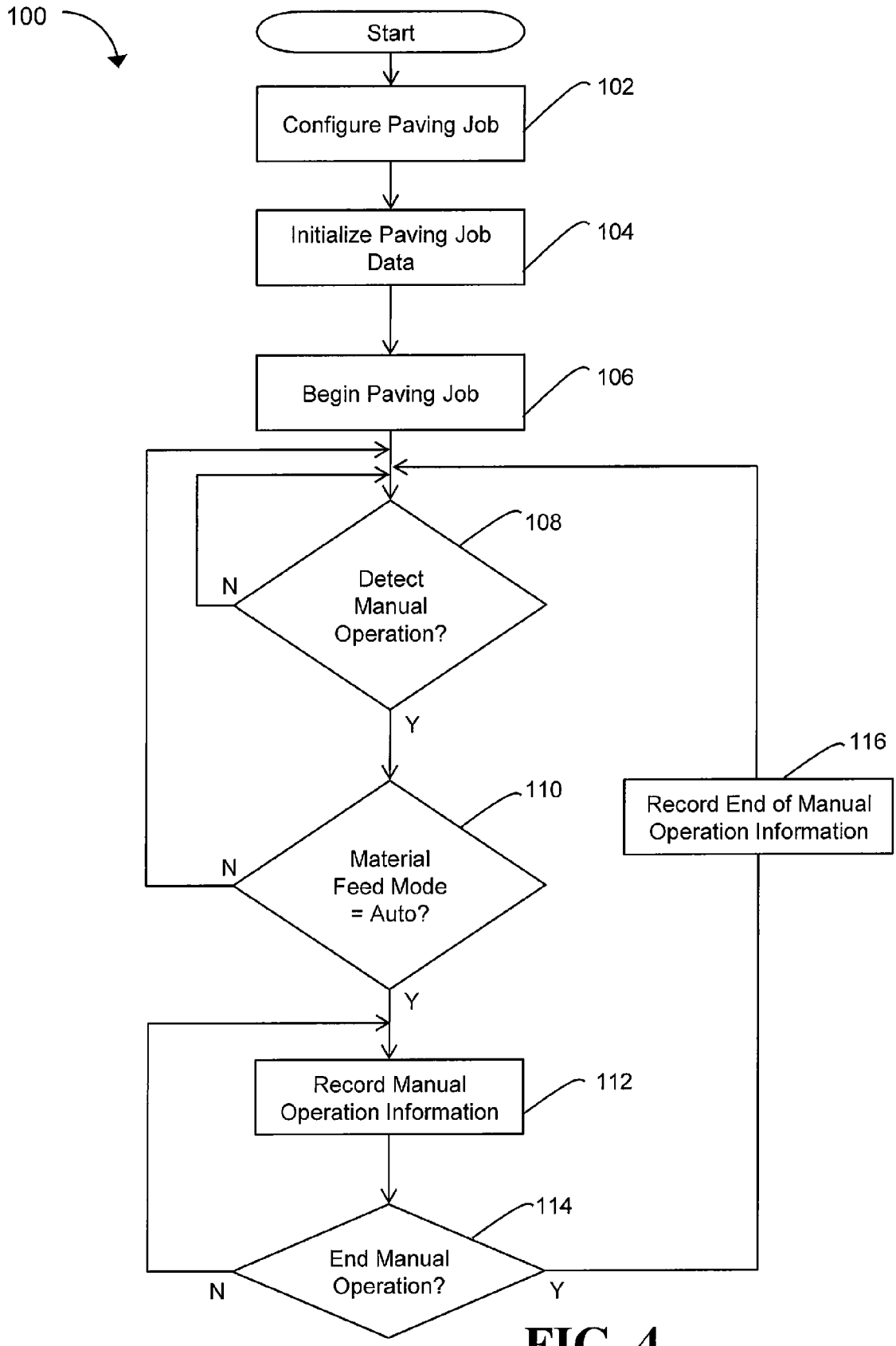
FIG. 4 is flow diagram of a manual operation tracking routine that may be implemented in the paving machine of FIG. 1.

FIG. 4 illustrates an embodiment of a routine 100 for tracking manual operations in a paving machine 10 while being operated automatically by the controller 42 to lay the mat 26 on the paving surface 12. The routine 100 starts at a block 102 where the specifications for a paving job are configured in the controller 42. As discussed above, the specifications for the paving job are input to the controller 42 in any appropriate manner, including entry at the machine display 90 or other input device at the user interface 44, or downloading from a peripheral device or remote computing device. The paving job specifications can include settings for the speed of the paving machine 10, the temperature and height of the screed 22, the heights and speeds of the augers 28, and the speeds of the conveyors 46.

With the paving job programmed into the controller 42, the memory 62 of the controller 42 is initialized prior to recording data for the paving job at a block 104. The software in the controller 42 records information on each discrete manual operation performed during the paving job. The initialization of the memory 62 includes resetting various counters that may be used to identify each occurrence of stopping the paving machine 10, changing the speeds of the augers 28 and conveyors 46, raising the sides of the hopper 20, and the like. The initialization process at block 104 may include these or any other data storage preparation tasks that may be required to prepare the controller 42 for recording information for the manual operations.

The paving process for a job begins at a block 106. For some jobs, or for portions of jobs for which the paving machine 10 is programmed for automated control, the paving machine 10 may be operated manually to lay the mat 26. During manual operation, the operator manipulates the controls 74-88, the machine display 90 and other controls to operate the paving machine 10. The operator is able to select a paving mode at an appropriate control to allow the components to be controlled for the paving process. This is in contrast to a non-paving mode that is used when the paving machine 10 is operational but not paving, such as when the paving machine 10 is moved from one paving location to another without laying the mat 26. In the non-paving mode, certain components may be de-actuated or placed in inactive positions so that the asphalt material is not dispensed from the hopper 20. The paving machine 10 may also have a material feed mode that may be set to a manual mode during the manual paving process to allow the operator to control the components. In the manual mode, the components will respond when the operator manipulates the controls 74-88, but are not controlled by the controller 42 according to the programmed paving specifications.

When desired to automatically operate the paving machine 10 under the control of the controller 42 and the programmed paving job specifications, the material feed mode is set to an auto mode. When switched to the auto mode, the controller 42 takes over operation of the components such as the screed heating elements and height actuators 54, the augers 28 and the conveyors 46 to form the mat 26 according to the specification when the transmission control 76 is set to propel the paving machine 10 forward. Switching to the auto mode may also cause the controller 42 to record information relating to the execution of the programmed paving job, such as the start time and location, identification of a paving crew that is operating the paving machine 10, and the like. Despite the automatic control provided by the controller 42, the operator is still able to manually intervene in the automated paving process via the controls 74-88 and the machine display 90 as necessary to address issues arising as the mat 26 is laid.

Once the machine mode is set to paving mode and the paving process begins at block 106, the controller 42 monitors the controls 74-88 and the machine display 90 for manual intervention by the operator. At a block 108, the controller 42 monitors the statuses of the controls 74-88 and the machine display 90 for detection of a manual operation. If the controller 42 does not detect actuation of any of the controls 74-88 or the machine display 90, control passes back to the block 108 to continue monitoring the actuation statuses of the controls 74-88 and the machine display 90.

If the controller 42 detects a status change at the block 108, control passes to a block 110 to determine whether the paving machine 10 is in the automatic paving mode and, consequently, the manual operation should be recorded. If the paving machine 10 is not operating in the auto mode, it is not necessary to record the individual manual operations performed by the operator. If the material feed mode is set to the manual mode (i.e., the auto mode is turned off), control will pass back to the block 108 for the controller 42 to continue monitoring for manual operations. If, on the other hand, the controller 42 is controlling the operation of the paving machine 10 and the material feed mode is set to the auto mode, control passes to a block 112 where the controller 42 begins recording information relating to the manual operation being performed.

In general, for each manual operation, the controller 42 records the job number or other job identifier, the manual operation being performed, a number of the occurrence of the manual operation (each manual operation may have an occurrence counter that is initialized in block 104 and incremented in block 112), the start time and start location for the occurrence of the manual operation, the control setting manually set by the operator, a reason or cause for performing the manual operation, and the like. The start location may be determined by global positioning system (GPS) functionality implemented in the paving machine 10. Additional or alternative information may be recorded based on the manual operation being performed, reporting requirements designated by the contractor, and the like. For example, contractors having multiple jobs being performed simultaneously may have interest in knowing which of multiple paving crews was working a particular job and making the decisions to perform the manual operations. This may allow the contractor to identify workers having repetitive operating issues and perhaps may be in need of additional training. Consequently, the controller 42 may record a paving crew identifier with the other information for the manual operation occurrence. Those skilled in the art will understand that the controller 42 may be configured to record any relevant information for identifying the locations at which manual operations are performed and corresponding potential mat defects, and the reason for performing the manual operations, may be identified and recorded by the controller 42, and the collection and use of such information is contemplated by the inventors as having use in paving machines 10 and manual operation tracking systems in accordance with the present disclosure.

After recording the initial information for the manual operation, control passes to a block 114 where the controller 42 determines whether the manual operation has ended and the controller 42 is again controlling the paving machine 10 according to the paving job specifications. If the statuses of the controls 74-88 and the machine display 90 indicate that the manual operation is still occurring, control may pass back to the block 112 to continue recording information related to the manual operation as necessary. It may not be necessary to record any addition information if no changes are made to the manual operation. However, it may be desirable to record information relating to changes in the manual operation if the operator makes further adjustments via the controls 74-88 and machine display 90. For example, the controller 42 may record changes at the conveyor speed control(s) 86 where the operator adjusts the speed of the conveyor(s) 46 to get the necessary flow of asphalt material from the hopper 20 to the pile 48.

If the manual operation is determined to have ended at the block 114, control passes to a block 116 where the controller 42 records any appropriate information relating to the ending of the manual operation. The information may include the ending time and ending location for the manual operation. Additionally, the tracking software may include functionality allowing the operator to enter a resolution to the issue that caused the manual operation to be performed at the machine display 90 or other input device. In such implementations, the operator of the paving machine 10 may be able input, for example, that a noise made by the paving machine 10 caused the operator to stop the paving machine 10 and investigate. After the end of manual operation information is recorded at the block 116, control passes back to the block 108 so that the controller 42 can continue monitoring the controls 74-88 and machine display 90 for additional manual operations performed by the operator.

INDUSTRIAL APPLICABILITY

The manual operation tracking routine 100 described above is executed when the paving machine 10 is operated to lay the mat 26 over the paving surface. At the beginning of the paving job, the specifications for the job are input to the controller 42 via the machine display 90 or other input device, or downloaded to the controller 42 from a remote computing device or peripheral device (block 102), and the controller 42 initializes the paving job data in the RAM 66 (block 104) so the paving machine 10 is prepared to automatically execute the paving job. At the beginning of the paving job or at any time during the paving job, the operator may manually control the paving machine 10 to lay the mat 26.

During manual control of the paving process, the operator sets the material feed mode to the manual mode via an appropriate control at the user interface 44, and operates the controls 74-88 and machine display 90 to cause the paving machine 10 to produce the mat 26. While in the manual mode, the controller 42 receives signals from the controls 74-88 and machine display 90 and causes the components 16, 22, 28, 46, 54, 70, 72 of the paving machine 10 to operate in response to the operator's commands. When the controller 42 detects the manual operation of the paving machine 10 by the operator at block 108, the controller 42 then checks the material feed mode at block 110 and determines that the paving machine 10 is operating in the manual mode. Because the operator is in control of the paving machine 10, the controller 42 does not record information for the manual operation of the paving machine 10 (block 112), but continues to monitor the control signals being transmitted from the operation console 38 and operate the paving machine 10 in response.

When the paving machine 10 and the paving process are to be automatically controlled by the controller 42, the operator sets a material feed mode control to the auto mode setting. The controller 42 detects the change to the auto mode and proceeds to execute the programmed paving job stored in the memory 62. The automatic control of the paving process may include setting the height and temperature of the screed 22, setting the height and speed of the augers 28 and setting the speed of the conveyors 46. When the hopper 20 is filled with a load of asphalt material, the operator may actuate the transmission control 76 from a neutral position to a propel position to cause the transmission 70 to engage and drive the traction device 18. As the paving machine 10 moves forward, the paving machine 10 dispenses the asphalt material and forms the mat 26 according to the programmed specifications for the paving job.

During the automated paving process, various conditions may arise causing the operator to manually intervene in the process. Ideally during the paving job, the hopper 20 is continually refilled while the paving machine 10 is propelled forward. Dump trucks filled with asphalt material back up to the front of the paving machine 10 as the mat 26 is laid, and then move forward at the approximate speed of the paving machine 10 and raise their beds to dump the asphalt material into the hopper 20. The paving machine 10 continues to operate under the control of the controller 42 according to the specifications for the paving job as long as the dump trucks replenish the asphalt material in the hopper 20. If the asphalt material is not replenished in a timely manner, the operator may intervene.

Where asphalt material does not completely feed to the conveyors 46 in the middle of the hopper 20 and accumulates at the sides, and a dump truck has not arrived to replenish the asphalt material, the accumulated material may be directed to the conveyors 46 by raising the sides of the hopper 20. The accumulated material at the sides may have cooled sufficiently to cause segregation of material in the asphalt mixture and risk compaction and other defects in the mat 26 when the accumulated material is used. Therefore, it is desirable to the contractor to know when the accumulated material is laid on the paving surface 12. At the block 108, the controller 42 detects the actuation of the hopper position control(s) 88 by the operator to raise one or both sides of the hopper 20. After determining that the material feed mode is set to the auto mode at the block 110, the controller 42 begins recording information related to the operation of the hopper side actuator(s) 72 at the block 112. The information can include an occurrence number assigned to the instance of raising the sides of the hopper 20, and a timestamp and GPS coordinates at the time that the hopper position control 88 was actuated. When the hopper position control 88 is operated to lower the sides of the hopper 20, the controller 42 detects the end of the manual operation at the block 114 and may record relevant information at the block 116 such as a timestamp and GPS coordinates so that the duration of the manual operation and the full location of the potentially defective portion of the mat 26 may be determined.

Where a delay in the arrival of a dump truck comes close to exhausting the supply of asphalt material in the hopper 20, the operator may need to stop the paving machine 10 before the pile 48 of asphalt material is depleted. The operator moves the transmission control 76 from the propel position to the neutral position to disengage the transmission 70 from the traction device 18 or otherwise stop the paving machine 10 from being propelled forward. The controller 42 detects the setting of the transmission control 76 to the neutral position at the block 108 and determines that the material feed mode is set to the auto mode at the block 110. In response, the controller 42 begins recording information related to the machine stop occurrence at the block 112. As with the actuation of the hopper 20, the information can include an occurrence number assigned to the instance of machine stop, and a timestamp and GPS coordinates at the time that the transmission control 76 was set to neutral.

Figure 5:
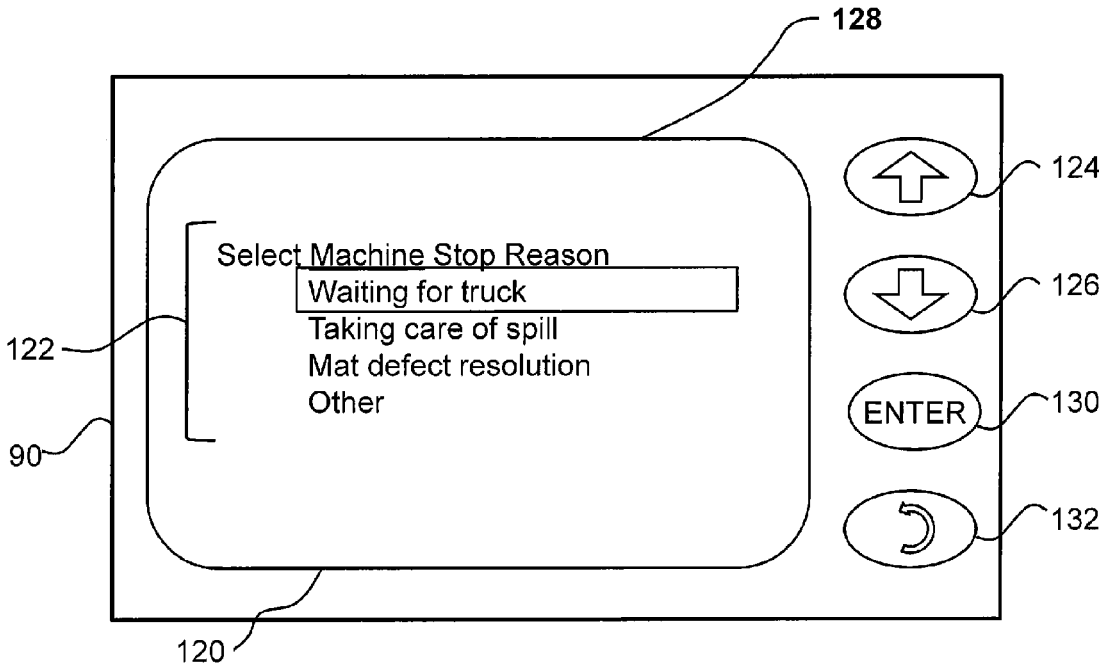
FIG. 5 is a front view of a machine display of the paving machine of FIG. 1 displaying a machine stop reason selection list.

The controller 42 may be configured to receive additional information related to stopping the paving machine 10, such as a reason for stopping the paving machine 10. FIG. 5 illustrates one embodiment of the machine display 90 wherein the operator provides input regarding the cause of the machine stop. A display screen 120 provides a list 122 of machine stop reasons from which the operator may choose to note the reason for stopping the paving machine 10. The operator uses an up arrow key 124 and a down arrow key 126 to move a cursor or highlight box 128 through the potential reasons for stopping the paving machine 10, such as waiting for a truck, taking care of an asphalt material spill, resolving a mat defect issue, or other reason. When the appropriate reason is highlighted, the operator presses an Enter key 130, and the controller 42 will record the selected reason along with the other information for the occurrence of the machine stop. After the selection is made, the operator returns to a previous screen via a Return key 132. When the cause of the machine stop is resolved and the transmission control 76 is moved back to the propel position, the controller 42 detects the end of the machine stop at the block 114 and records relevant information at the block 116 such as a timestamp and GPS coordinates. The controller 42 may also cause the machine display 90 to display a machine stop resolution list or other input display in a similar manner as the machine stop reason list 122 of FIG. 5 to allow the operator to specify a resolution to the cause of the machine stop and have the resolution stored in the memory 62 with the other information for the machine stop occurrence.

The embodiment of the machine display 90 shown in FIG. 5 is exemplary only. Those skilled in the art will understand that other types of devices or combinations of devices providing a display of information and the input of information may be implemented at the operation console 38. For example, the display screen 120 may be supplemented with a full keyboard, or the display screen 120 may be a touch screen providing a virtual keyboard, to allow the operator to type in occurrence-specific machine stop reasons and resolutions to provide the contractor with more detailed information regarding the manual interventions by the operator. Additional alternative display and input mechanisms are contemplated by the inventors and may be implemented in the paving machine 10.

Manual intervention by the operator may be required even where sufficient asphalt material is available in the hopper 20 to feed to the screed 22. Situations arise where the operation of the components of the paving machine 10 according to the programmed paving job specifications may not form the mat 26 as desired. The speed of the conveyor(s) 46 and the speed and height of the augers 28 may provide too much or too little asphalt material to form the mat 26, or improperly distribute the asphalt material in the pile 48 across the width of the screed 22, so that the mat 26 is not properly formed on the paving surface 12. The operator may have to perform a manual feed override and adjust the settings for the conveyor(s) 46 and augers 28 to properly form the mat 26. Each time actuation of one of the material feed controls 82-86 to manually override the programmed specifications is detected by the controller 42 at the block 108 and the controller 42 confirms that the paving machine 10 is operating in the auto material feed mode at the block 110, the controller 42 begins recording information relating to the operator's manual intervention at the block 112. The controller may record similar information to that described above, such as the occurrence number of the manual operation, and the time stamp and GPS location at which the manual operation began. The controller 42 may also record the manual settings for the conveyor(s) 46 and augers 28, such as the adjusted speed of the conveyor(s) 46 and the adjusted height of the augers 28. The controller 42 continues monitoring and recording manual changes to the settings until detecting the controls 84-86 being reset according to the programmed specifications at the block 114 and recording the data for the end of the manual operation at the block 116.

The discussion of tracking information for hopper side actuations, machine stop occurrences and material feed overrides is exemplary only. Those skilled in the art will understand that other types of manual interventions in the operation of the paving machine 10 by the operator, such as changing the height or temperature of the screed 22, may be necessary during operation of the paving machine 10 under the control of the controller 42 and may affect the quality and consistency of the mat 26. Such additional manual operations may be detected by the controller 42, and the controller 42 may record information related to each occurrence of the manual operation in a similar manner as described above.

Figure 6:
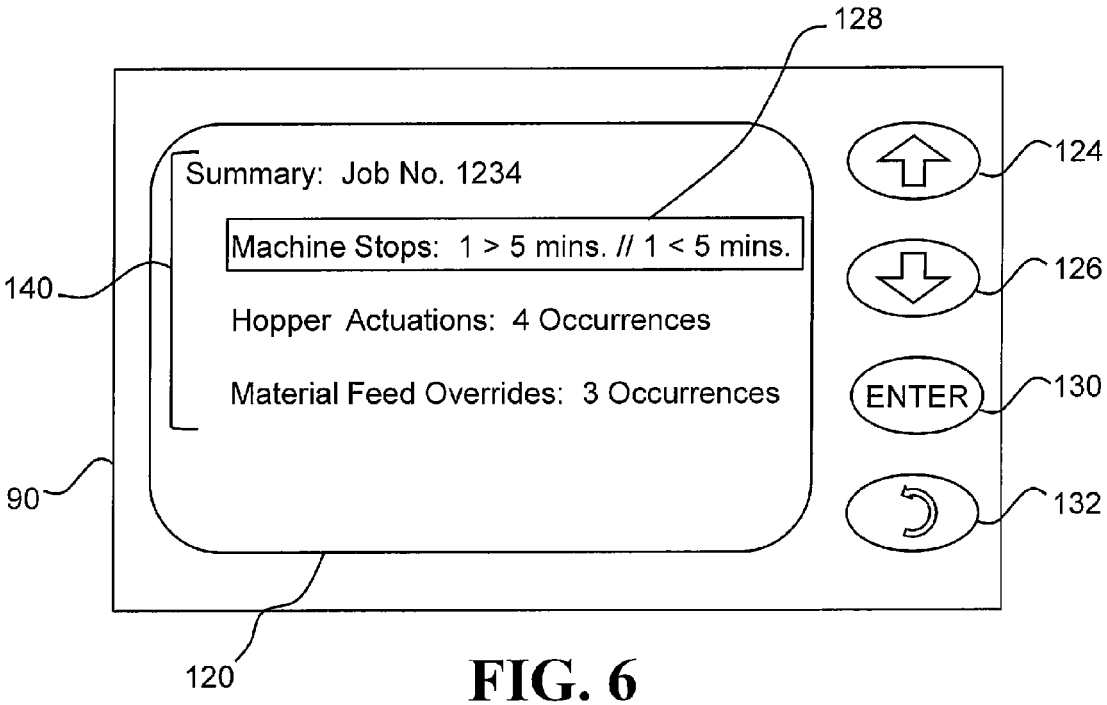
FIG. 6 is a front view of the machine display of the paving machine of FIG. 1 displaying a paving job summary screen.

The information for the manual operations recorded by the controller 42 may be provided to the contractor via any appropriate media and in any appropriate format. The information may be downloaded from the paving machine 10 to an attached peripheral storage device, or may be transmitted to a remote computing device by a direct connection or by a wireless communication means. The information may also be displayed at the paving machine 10 at an output device such as the machine display 90. FIG. 6 illustrates an example of a paving job summary 140 that is provided at the display screen 120 of the machine display 90. The paving job summary 140 includes identification information for the paving job being displayed, along with a summary of the occurrences for each type of manual operation that can be recorded. For each manual operation, the paving job summary 140 includes the number of occurrence of the operation. Where the duration of the manual operation is important, such as for machine stops, the summary also includes detail on the number of occurrences that were less than or greater than a predetermined threshold machine stop duration.

Figure 7:
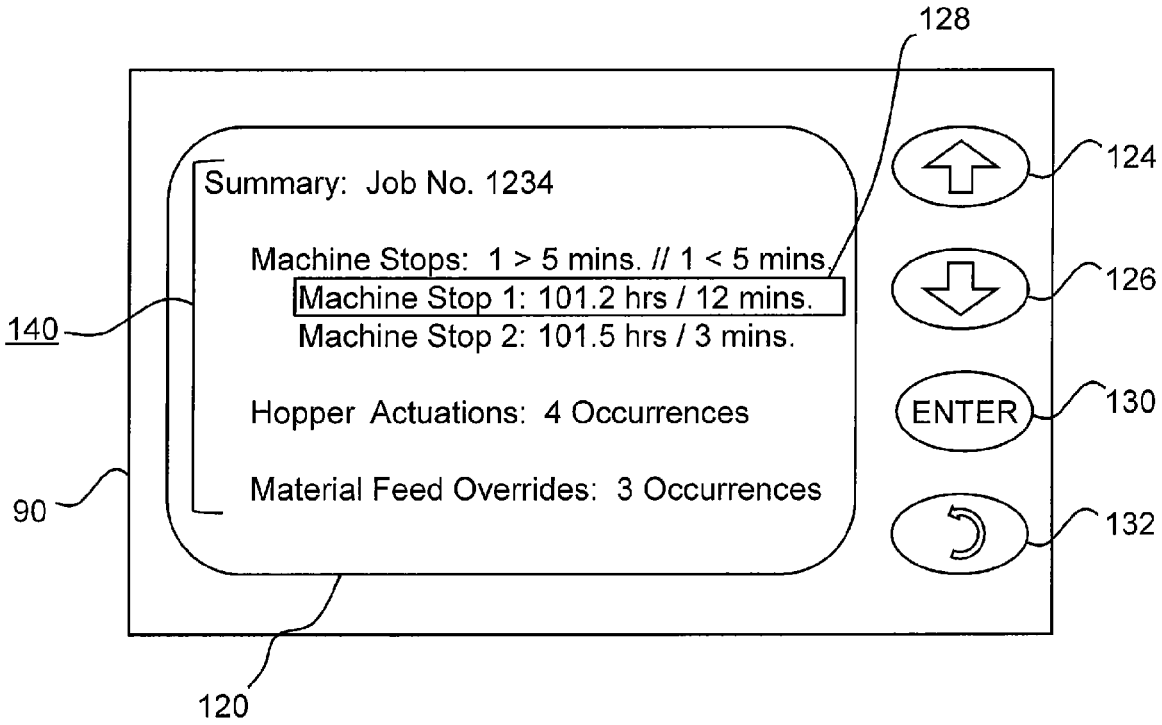
FIG. 7 is a front view of the machine display of the paving machine of FIG. 1 displaying the paving job summary screen with a machine stop detail list.

The paving job summary 140 allows the viewer to select a particular manual operation and retrieve greater detail on the occurrences of the operation during the paving job. In a similar manner as the operator navigated the machine stop reasons as described above, the operator may use the arrow keys 124, 126 to move the highlight box 128 through the listed manual operations to an operation of interest, such as the machine stops, and then press the Enter key 130 to retrieve and display more detailed information on each occurrence as shown in FIG. 7. The detailed information may include the time of the occurrence (machine use hours as shown or actual start time from the recorded timestamp) and the duration of the manual operation. Additional information that may be displayed may include the location of the occurrence of the manual operation where the GPS data is recorded for the occurrence. After the reviewing the occurrence information, the operator may collapse the detail information for the manual operation by pressing the Return key 132.

While paving machines 10 laying a mat 26 on a paving surface 12 are described herein, the manual operation tracking method may be used in any type of work machine that may be automatically controlled to traverse a work surface and perform operations on the work surface, and where manual intervention in the automated process may indicate issues with the process and potential defects or inconsistencies in the surface as a result of the manual intervention. Such work machines include motor graders, road reclaimers, wheel tractor scrapers and other machines having at least some degree of automated control over the engagement of the work surface by the implements of the work machines and where manual intervention by an operator may signal operational issues and impact the quality of the work performed on the surface.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

What is claimed is:

1. A paving machine for performing a surface-engaging operation on a work surface traversed by the paving machine, the paving machine comprising:

a traction device for propelling the paving machine over the work surface;

a plurality of components each having an effect on the surface-engaging operation performed by the paving machine;

a plurality of operator controls, each of the plurality of operator controls corresponding to one of the plurality of components; and a controller operatively coupled to the plurality of components and the plurality of operator controls, the controller being configured to detect actuation of each of the plurality of operator controls, the controller being configured to cause a corresponding at least one of the plurality of components to actuate in response to detecting actuation of one of the plurality of operator controls, the controller being programmed to automatically operate the plurality of components to perform the surface-engaging operation without actuation of corresponding operator controls in response to engagement of an auto mode, and the controller being programmed to record information corresponding to a manual operation of at least one of the plurality of components in response to detecting actuation of the corresponding one of the plurality of operator controls by an operator of the paving machine and determining that the auto mode is engaged, wherein the controller is configured to record a start location for the manual operation in response to detecting actuation of the one of the plurality of operator controls and determining that the auto mode is engaged.

2. The paving machine of claim 1, wherein the controller is configured to record a start time for the manual operation in response to detecting actuation of the one of the plurality of operator controls and determining that the auto mode is engaged.

3. The paving machine of claim 1, wherein the controller is configured to record a manual operation reason for the manual operation in response to detecting actuation of the one of the plurality of operator controls and determining that the auto mode is engaged.

4. The paving machine of claim 3, wherein the paving machine comprises a machine display and an input device operatively coupled to the controller, wherein the controller is configured to display a list of alternative machine operation reasons at the machine display in response to detecting actuation of the one of the plurality of operator controls and determining that the auto mode is engaged, wherein the controller is configured to receive an input signal from the input device indicating a selection of one of the alternative machine operation reasons by the operator at the input device, and wherein the controller is programmed to record the one of the alternative machine operation reasons indicated by the input signal from the input device.

5. The paving machine of claim 1, wherein the controller is configured to assign a manual operation occurrence designation in response to detecting actuation of the one of the plurality of operator controls and determining that the auto mode is engaged such that each occurrence of the manual operation of the corresponding one of the plurality of components is assigned a unique manual operation occurrence designation.

6. The paving machine of claim 1, wherein the controller is configured to record at least one of an end time and an end location for the manual operation in response to detecting actuation of the one of the plurality of operator controls to restore automatic control by the controller of the at least one of the plurality of components.

7. The paving machine of claim 1, wherein the controller is configured to record manual operation resolution information for the manual operation in response to detecting actuation of the one of the plurality of operator controls to restore automatic control by the controller of the at least one of the plurality of components.

8. The paving machine of claim 1, wherein the surface-engaging operation comprises the plurality of components forming a mat of paving material on the work surface as the paving machine is propelled over the work surface, wherein the plurality of operator controls comprises a transmission control having a propel position causing the controller to actuate at least one of the plurality of components to propel the paving machine over the work surface and a neutral position causing the controller to deactivate the at least one of the plurality of components to stop propulsion of the paving machine, and wherein the controller is programmed to record information corresponding to a machine stop manual operation in response to detecting a transition of the transmission control from the propel position to the neutral position and determining that the auto mode is engaged.

9. The paving machine of claim 1, wherein the surface-engaging operation comprises the plurality of components forming a mat of paving material on the work surface as the paving machine is propelled over the work surface, wherein at least one of the plurality of operator controls provides signals to the controller for causing at least one of the plurality of components to feed paving material to the mat of paving material, and wherein the controller is programmed to record information corresponding to a material feed override manual operation in response to detecting actuation of the at least one of the plurality of operator controls and determining that the auto mode is engaged.

10. The paving machine of claim 1, wherein the surface-engaging operation comprises the plurality of components forming a mat of paving material on the work surface as the paving machine is propelled over the work surface, wherein the paving machine comprises a hopper having articulated sides that raise to cause paving material disposed in the hopper to feed to the middle of the hopper, wherein the plurality of components comprises hopper side actuators operably coupled to raise and lower the articulated sides of the hopper, wherein the plurality of operator controls comprises a hopper position control operative to provide control signals to the controller for causing the hopper side actuators to raise and lower the articulated sides of the hopper, and wherein the controller is programmed to record information corresponding to a hopper actuation manual operation in response to detecting actuation of the hopper position control to raise the articulated sides of the hopper and determining that the auto mode is engaged.

11. A method for tracking manual operations of a paving machine when the paving machine is under automatic control of a controller to perform a surface-engaging operation on a work surface traversed by the paving machine, the paving machine having a traction device for propelling the paving machine over the work surface, a plurality of components each having an effect on the surface-engaging operation performed by the paving machine, and a plurality of operator controls, each of the plurality of operator controls corresponding to one of the plurality of components, the method comprising:

automatically operating the plurality of components to perform the surface-engaging operation without actuation of corresponding operator controls in response to engagement of an auto mode;

detecting actuation of one of the plurality of operator controls by an operator of the paving machine;

causing a corresponding at least one of the plurality of components of the paving machine to actuate to execute a manual operation in response to detecting actuation of the one of the plurality of operator controls;

recording information corresponding to the manual operation of the at least one of the plurality of components in response to detecting actuation of the one of the plurality of operator controls and determining that the auto mode is engaged; and recording a start location for the manual operation in response to detecting actuation of the one of the plurality of operator controls and determining that the auto mode is engaged.

12. The method of claim 11, comprising recording a start time for the manual operation in response to detecting actuation of the one of the plurality of operator controls and determining that the auto mode is engaged.

13. The method of claim 11, comprising recording a manual operation reason for the manual operation in response to detecting actuation of the one of the plurality of operator controls and determining that the auto mode is engaged.

14. The method of claim 13, comprising:

displaying a list of alternative machine operation reasons at a machine display of the paving machine in response to detecting actuation of the one of the plurality of operator controls and determining that the auto mode is engaged;

receiving an input signal from an input device of the paving machine indicating a selection of one of the alternative machine operation reasons by the operator at the input device; and recording the one of the alternative machine operation reasons indicated by the input signal from the input device.

15. The method of claim 11, comprising assigning a manual operation occurrence designation in response to detecting actuation of the one of the plurality of operator controls and determining that the auto mode is engaged such that each occurrence of the manual operation of the corresponding one of the plurality of components is assigned a unique manual operation occurrence designation.

16. The method of claim 11, comprising recording at least one of an end time and an end location for the manual operation in response to detecting actuation of the one of the plurality of operator controls to restore automatic control by the controller of the at least one of the plurality of components.

17. The method of claim 11, comprising recording manual operation resolution information for the manual operation in response to detecting actuation of the one of the plurality of operator controls to restore automatic control by the controller of the at least one of the plurality of components.

18. The method of claim 11, wherein the surface-engaging operation comprises the plurality of components forming a mat of paving material on the work surface as the paving machine is propelled over the work surface, wherein the plurality of operator controls comprises a transmission control having a propel position causing the paving machine to be propelled over the work surface and a neutral position causing the paving machine to remain stationary, the method comprising:

detecting a transition of the transmission control from the propel position to the neutral position; and recording information corresponding to a machine stop manual operation in response to detecting the transition of the transmission control and determining that the auto mode is engaged.

19. The method of claim 11, wherein the surface-engaging operation comprises the plurality of components forming a mat of paving material on the work surface as the paving machine is propelled over the work surface, wherein at least one of the plurality of operator controls causes at least one of the plurality of components to feed paving material to the mat of paving material, the method comprising:

detecting actuation of the at least one of the plurality of operator controls; and recording information corresponding to a material feed override manual operation in response to detecting actuation of the at least one of the plurality of operator controls and determining that the auto mode is engaged.

20. The method of claim 11, wherein the surface-engaging operation comprises the plurality of components forming a mat of paving material on the work surface as the paving machine is propelled over the work surface, wherein the paving machine includes a hopper having articulated sides that raise to cause paving material disposed in the hopper to feed to the middle of the hopper, wherein the plurality of operator controls comprises a hopper position control operative to provide control signals for causing the articulated sides of the hopper to be raised and lowered, the method comprising detecting actuation of the hopper position control to raise the articulated sides of the hopper; and recording information corresponding to a hopper actuation manual operation in response to detecting actuation of the hopper position control to raise the articulated sides of the hopper and determining that the auto mode is engaged.

* * * * *